US005828936A

United States Patent [19]

Shimizu et al.

[11] Patent Number: 5,828,936

[45] Date of Patent: Oct. 27, 1998

[54] DEVELOPING DEVICE

[75] Inventors: Tamotsu Shimizu, Settsu; Eiji Gyotoku, Itami, both of Japan

[73] Assignee: Minolta Co., Ltd., Osaka, Japan

[21] Appl. No.: 831,330

[22] Filed: Mar. 31, 1997

[30] Foreign Application Priority Data

Apr. 2, 1996 [JP] Japan ..... 8-106283

[51] Int. Cl.[6] ..... G03G 15/09

[52] U.S. Cl. ..... 399/275; 399/276

[58] Field of Search ..... 399/264, 267, 399/274, 275, 276, 277

[56] References Cited

U.S. PATENT DOCUMENTS

| | | | |
|---|---|---|---|
| 4,391,512 | 7/1983 | Nakamura et al. | 399/275 |
| 4,511,239 | 4/1985 | Kanbe et al. | 399/275 X |
| 4,887,131 | 12/1989 | Kinoshita et al. | 399/275 |
| 5,153,377 | 10/1992 | Kuwashima et al. | 399/274 |

FOREIGN PATENT DOCUMENTS

| | | |
|---|---|---|
| 60-243683 | 12/1985 | Japan . |
| 2-73383 | 3/1990 | Japan . |

*Primary Examiner*—R. L. Moses
*Assistant Examiner*—Hoan Tran

[57] ABSTRACT

A developing device is provided with a magnetic member having a plurality of magnetic poles N and S within a developing sleeve that rotates to transport a developer to an image bearing member. The device also includes a regulating member, which is formed of magnetic material, and which is spaced from the developing sleeve in so that the surface of the regulating member that is located on the upstream side in the developer transport direction is positioned downstream in the developer transport direction from a point of peak perpendicular magnetic flux density of the opposing magnetic pole of a magnetic member near the position at which the regulating member faces the developing sleeve, and positioned upstream in the developer transport direction from a point of 1/2 the peak perpendicular magnetic flux density of the opposing magnetic pole.

5 Claims, 8 Drawing Sheets

DEVELOPING DEVICE

BACKGROUND OF THE INVENTION

1. Field of the Invention

The present invention relates to a developing device to develop an electrostatic latent image formed on an image bearing member in an image forming apparatus such as a copying machine, printer and the like. Specifically, the present invention relates to a developing device provided with a magnet member having a plurality of magnetic poles N and S and the like within a developing sleeve which transports developer to said image bearing member, and a regulating member to regulate the amount of developer transported by said developing sleeve and which is disposed opposite said developing sleeve so as to maintain a predetermined spacing therebetween.

2. Description of the Related Art

In conventional image forming apparatuses such as copying machines, printers and the like, various developing devices are used to develop an electrostatic latent image formed on an image bearing member.

One such developing device, shown in FIG. 12, is provided with a magnetic member 32 having a plurality of magnetic poles N and S within a developing sleeve 31 disposed opposite an image bearing member 1, wherein developer 2 maintained on the surface of said developing sleeve 31 via the magnetic force of said magnetic member 32 is transported to the image bearing member 1 side in conjunction with the rotation of said developing sleeve 31, and the amount of developer 2 transported to developing sleeve 31 is regulated by a regulating member 33 arranged so as to maintain a predetermined spacing relative to said developing sleeve 31, such that a suitable amount of developer is transported to a developing region opposite said image bearing member by developing sleeve 31 so as to develop the latent image formed on the surface of said image bearing member 1.

In recent years, regulation of the amount of developer transported by developing sleeve 31 to the region opposite the image bearing member 1 by a regulating member 33 has seen the development of arrangements using a regulating member 33 formed of magnetic material, wherein the amount of developer transported by developing sleeve 31 to a region opposite the image bearing member 1 is regulated to a suitable amount even when the gap Db is increased between the developing sleeve 31 and regulating member 33 by regulating the amount of developer 2 transported to a region opposite an image bearing member 1 via the lines of magnetic force facing said regulating member 33 from the opposing magnetic pole N opposite the regulating member 33 through developing sleeve 31, thereby avoiding blockage of developer 2 between regulating member 33 and developing sleeve 31.

When a regulating member 33 formed of magnetic material is used, the installation position of the regulating member 33 is subject to divergence, thereby producing a divergence in the positional relationship between said regulating member 33 and the opposing magnetic pole N of the magnetic member 32, such that when the gap Db changes between regulating member 33 and developing sleeve 31, the condition of the lines of magnetic force are changed from the opposing magnetic pole N to the regulating member 33 so as to prevent appropriate regulation of the amount of developer transported by developing sleeve 31 and cause a marked change in the amount of developer transported to the region opposite the image bearing member by developing sleeve 31 such that either too little or too much developer is transported to the image bearing member and prevents suitable development of the latent image.

SUMMARY OF THE INVENTION

In view of the previously mentioned disadvantages, a main object of the present invention is to provide stable and appropriate developing by stably supplying a constant amount of developer to an image bearing member without marked fluctuation of the amount of developer transported to a region opposite said image bearing member by a developing sleeve by regulating the transported developer in a stable condition via a regulating member.

Another object of the present invention is to provide a developing device providing stable regulation of developer transported on a developing sleeve via a regulating member even when there is slight divergence in the positional relationship between the regulating member and magnetic member.

A further object of the present invention is to provide a developing device providing stable regulation of developer transported on a developing sleeve via a regulating member even when the spacing changes between said regulating member and said developing sleeve.

The present invention achieves these objects by providing a developing device provided with a magnetic member having a plurality of magnetic poles N and S within a developing sleeve which rotates to transport developer to an image bearing member, and a regulating member formed of magnetic material disposed so as to maintain a predetermined spacing from said developing sleeve, wherein the relationship $t \geqq d/6$ is satisfied when the thickness of said regulating member is designated t, and the distance on the developing sleeve is designated d between points where the perpendicular magnetic flux density become 0 (zero) on the upstream side and downstream side in the developer transport direction at the opposing magnetic pole of said magnetic member near the position at which the regulating member faces the developing sleeve.

According to the developing device of the present invention, when the thickness t of regulating member formed of magnetic material is set so as to be ⅙ or greater of the distance on the developing sleeve at a point where the perpendicular magnetic flux density becomes 0 (zero) on the upstream side and downstream side in the developer transport direction at the opposing magnetic pole of said magnetic member, there is minimal change in the number of lines of magnetic force from the opposing magnetic pole to the regulating member even when the positions of the regulating member and opposing magnetic pole diverge slighted such that the amount of developer transported by the developing sleeve to the image bearing member is stably regulated by the regulating member and transporting of too much or too little developer to the image bearing member by the developing sleeve is prevented so as to achieve stable development by the stable delivery of a suitable amount of developer to the image bearing member by the developing sleeve.

Furthermore, the present invention achieves these objects by providing a developing device provided with a magnetic member having a plurality of magnetic poles N and S within a developing sleeve which rotates to transport developer to an image bearing member, and a regulating member formed of magnetic material disposed so as to maintain a predetermined spacing from said developing sleeve, wherein the surface of the regulating member on the upstream side in the direction of developer transport is disposed downstream in the developer transport direction from a point of peak perpendicular magnetic flux density of the opposing magnetic pole of the magnetic member near the position at which the regulating member faces the developing sleeve, and upstream in the developer transport direction from a point of ½ the peak perpendicular magnetic flux density of said opposing magnetic pole.

In the developing device of the present invention, the lines of magnetic force from the opposing magnetic pole of the magnetic member are oriented toward the surface of the regulating member formed of magnetic material on the upstream side in the developer transport direction, so as to regulate the amount of developer transported by the developing sleeve to the image bearing member via the action of said lines of magnetic force.

When the surface of the regulating member on the upstream side in the developer transport direction is positioned downstream in the developer transport direction from a point of peak perpendicular magnetic flux density of the opposing magnetic pole, developer collects in the area of said peak perpendicular magnetic flux density, such that the amount of developer transported by the developing sleeve can be suitably regulated even when the spacing between the regulating member and developing sleeve is increased, and variation of the amount of developer transported by the developing sleeve is minimized even when the spacing between the regulating member and developing sleeve changes. Furthermore, even when the surface on the upstream side the regulating member is at a position downstream in the developer transport direction from a point of said peak perpendicular magnetic flux density, when the surface of the regulating member on the upstream side goes downstream in the developer transport direction from a point of ½ the peak perpendicular magnetic flux density of the opposing magnetic pole, the distance from the opposing magnetic pole becomes too long, such that the influence of the binding force of the developer is weakened by the opposing magnetic pole, and adequate regulation of the developer cannot be achieved by the line of magnetic force from the opposing magnetic pole to the regulating member.

According to the developing device of the present invention, when the surface of the regulating member on the upstream side in the developer transport direction is set at the aforesaid position, the amount of developer transported by the developing sleeve to the image bearing member can be regulated in a stable state even when the positions of the regulating member and opposing magnetic pole diverge slightly due to variation of the spacing between the regulating member and developing sleeve, thereby achieving stable development without delivering either too much or too little developer to the image bearing member.

The present invention achieves these objects by providing a developing device provided with a magnetic member having a plurality of magnetic poles N and S within a developing sleeve which rotates to transport developer to an image bearing member, and a regulating member formed of magnetic material disposed so as to maintain a predetermined distance from said developing sleeve, wherein the surface of the regulating member on the downstream side in the direction of developer transport is disposed downstream in the developer transport direction from a point of ½ the peak perpendicular magnetic flux density of the opposing magnetic pole of the magnetic member, and upstream in the developer transport direction from a point where the perpendicular magnetic flux density of said opposing magnetic pole becomes 0 (zero).

In the developing device of the present invention, the lines of magnetic force from the magnetic poles of a magnetic member positioned downstream in the developer transport direction from an opposing magnetic pole extend toward the surface of the regulating member formed of magnetic material downstream in the developer transport direction, so as to regulate the amount of developer transported by the developing sleeve to the image bearing member by the action of said lines of magnetic force.

When the surface of the regulating member on the downstream side in the developer transport direction is positioned downstream in the developer transport direction from a point where the perpendicular magnetic flux density of said opposing magnetic pole becomes 0 (zero), the magnetic brush formed between the opposing magnetic pole and the downstream magnetic pole is disrupted, causing irregular amounts of developer to be transported by the developing sleeve. Furthermore, when the surface of the regulating member on the downstream side is positioned upstream in the developer transport direction from a point of ½ the peak perpendicular magnetic flux density of the opposing magnetic pole, the influence of the magnetic lines of force from the downstream magnetic pole is weakened, so as to cause inadequate regulation of developer between the downstream magnetic pole and the regulating member and increase the amount of developer transported by the developing sleeve, thereby increasing the fluctuation of the amount of transported developer.

Furthermore, even more excellent effectiveness is achieved when the surface of the regulating member on the upstream side in the developer transport direction is positioned downstream in the developer transport direction from a point of peak perpendicular magnetic flux density of the opposing magnetic pole of a magnetic member near the position at which the regulating member faces the developing sleeve and positioned upstream in the developer transport direction from a point of ½ the peak perpendicular magnetic flux density of the opposing magnetic pole, and the surface of the regulating member on the downstream side in the developer transport direction is positioned downstream in the developer transport direction from a point of ½ the peak perpendicular magnetic flux density of the opposing magnetic pole and upstream in the developer transport direction from a point where the perpendicular magnetic flux density of said opposing magnetic pole becomes 0 (zero).

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the developing device of the present invention are described hereinafter with reference to the accompanying drawings, and the examples given will clearly show the excellence of the developing device satisfying the conditions of the present invention.

First Embodiment

Figure 1:
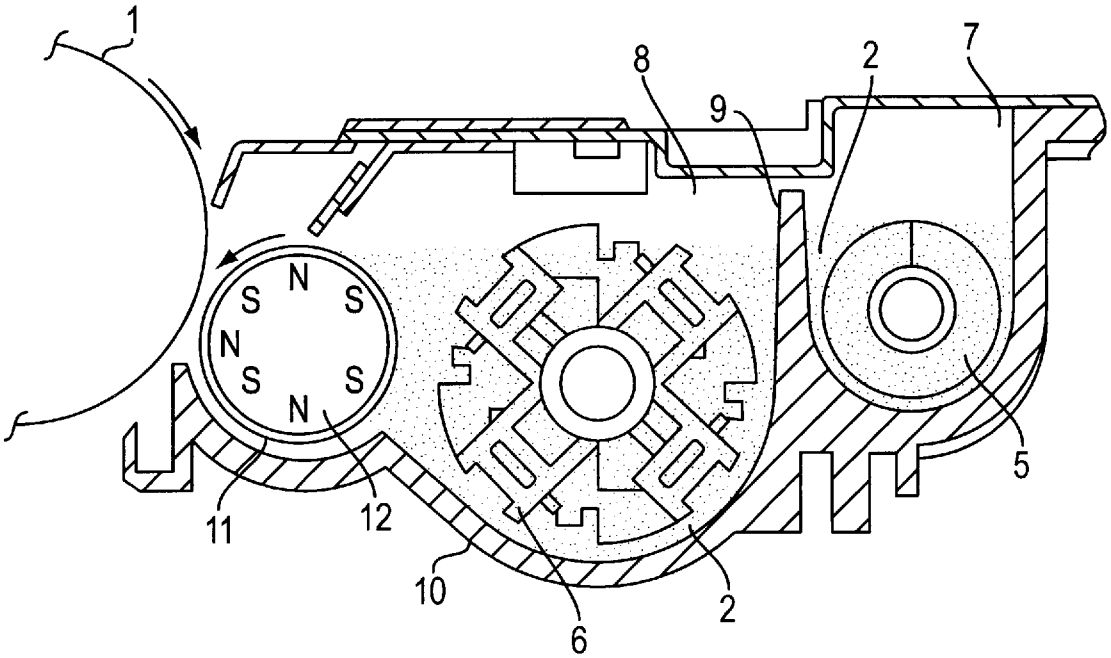
FIG. 1 briefly shows a developing device of the first embodiment of the present invention.

The developing device of this embodiment develops an electrostatic latent image formed on an image bearing member 1 using a two-component developer comprising a nonmagnetic toner and a magnetic carrier, said developing device being provided with a rotatable developing sleeve 11 disposed at an opening in housing 10 so as to confront image bearing member 1, and a panel 9 disposed along the axial direction of developing sleeve 11 in the interior of housing 10 so as to form a developer supply unit 8 and developer transport unit 7, as shown in FIG. 1. Transport members 6 and 5 are provided in the developer supply unit 8 and the developer transport unit 7, respectively, to mix and transport the developer 2, wherein said transport members 6 and 5 mix the developer 2 and transport the developer 2 in mutually opposite directions so as to circulate developer 2 within a transport path formed by developer supply unit 8 and developer transport unit 7.

A toner supply unit (not illustrated) is provided upstream in the developer transport direction from developer transport unit 7 and is connected to developer transport unit 7 to supply toner to developer transport unit 7.

Figure 2:
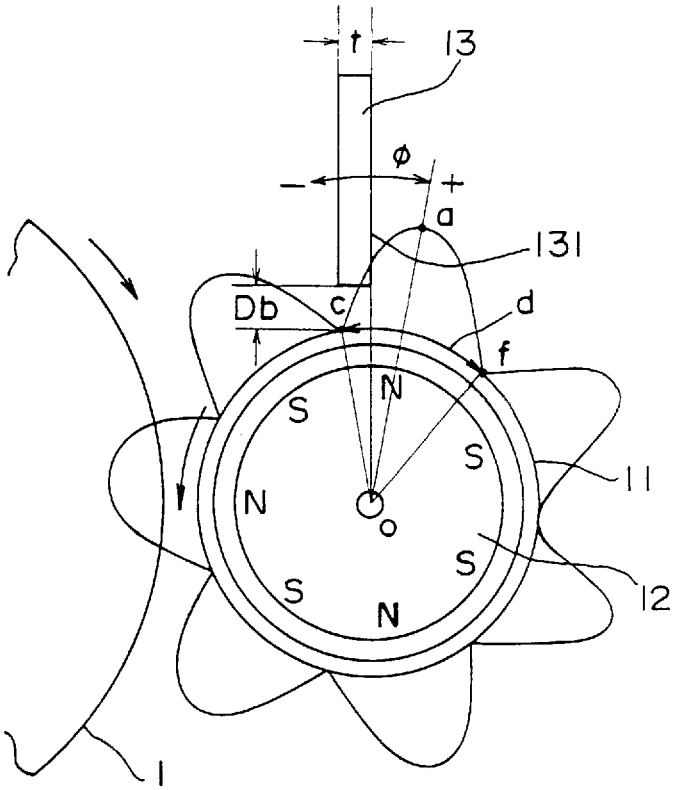
FIG. 2 is a brief partial view of the developing sleeve periphery in the first embodiment.

As shown in FIG. 2, the developing device is provided with a stationary magnetic member 12 having a plurality of magnetic poles N and S within a developing sleeve 11, and developer 2 is held on developing sleeve 11 via the magnetic force of magnetic member 12 and transported via the rotation of developing sleeve 11 relative to magnetic member 12. This developing device regulates the amount of developer transported to the image bearing member 1 by regulating the amount of developer on developing sleeve 11 via a regulating member 13, and thereafter developer is delivered to a developing region opposite image bearing member 1 by developing sleeve 11 to develop an electrostatic latent image formed on image bearing member 1.

The regulating member 13 is formed of magnetic material such as iron or metal alloy (e.g., SUS 430) or the like, and is disposed at the position of one magnetic pole N of magnetic member 12 in the vicinity of opposition. When the positions at which the perpendicular magnetic density is zero (0) on the upstream side and downstream side of the opposing magnetic pole N in the developer transport direction are designated f and c, the distance from said point c to said point f on the surface of developing sleeve 11 is designated d, and the thickness of regulating member 13 is designated t, said regulating member 13 is arranged so as to satisfy the relationship $t \geqq d/6$.

When the amount of developer transported to the region opposite image bearing member 1 via developing sleeve 11 is regulated using the aforesaid regulating member 13, the change in the amount of developer regulated by regulating member 13 is minimal even when the positions of regulating member 13 and the opposing magnetic pole N of magnetic member 12 diverge somewhat, such that stable developing is accomplished by stable transport of a constant amount of developer via developing sleeve 11.

EXAMPLE 1

In this example, a plurality of regulating members having different thicknesses and formed of materials were used and the position of the opposing magnetic pole relative to the regulating member was varied to measure the change of the amount of developer passing by the regulating member for each regulating member. The mean particle size of the toner used in each of the following examples was 8 $\mu$m, and the mean particle size of the carrier was 35 $\mu$m.

First, magnetic member 12 was set to have a distance d of 15 mm between points c and f on developing sleeve 11 at which the perpendicular magnetic flux density of opposing magnetic pole N was zero (0) upstream and downstream in the developer transport direction, and a distance Db of 0.3 mm was set between each regulating member 13 and developing sleeve 11. One regulating member 13 was formed of nonmagnetic material, and three magnetic members 13 were formed of magnetic material at a thickness of d/12, d/6, and d/3.

Figure 3:
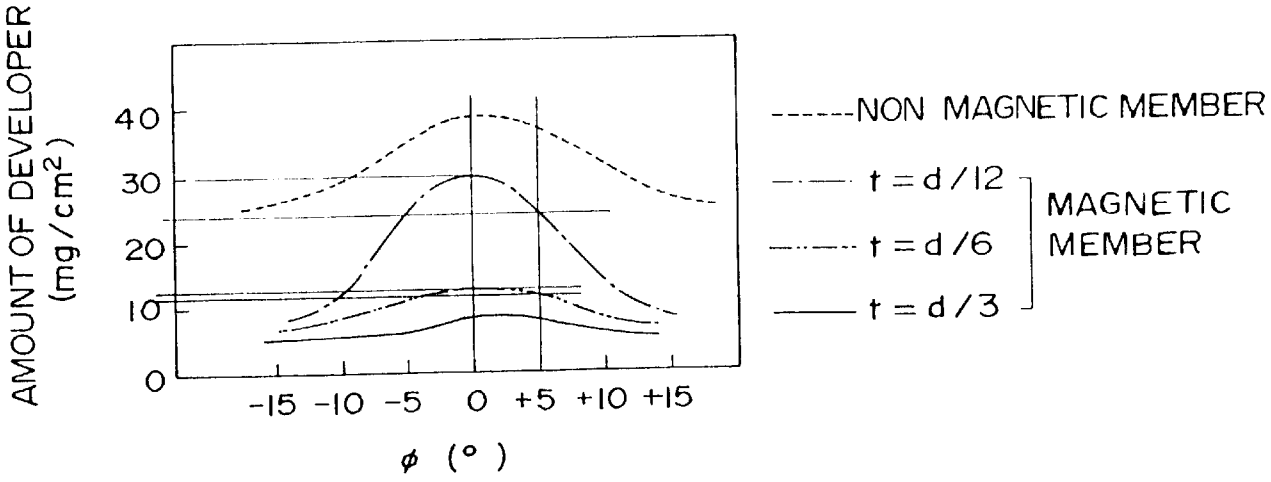
FIG. 3 shows the change in the amount of transported developer when the distance Db between the regulating member and the developing sleeve and the thickness of the regulating member are varied in the developing device of the first embodiment.

The angle $\phi$ at the center 0 of the developing sleeve 11 formed by point a at the peak perpendicular magnetic flux density at opposing magnetic pole N and the upstream surface 131 of each regulating member 13 in the developer transport direction was changed by varying the position of the opposing magnetic pole N of magnetic member 12 to measure the change of the amount of developer transported past regulating member 13 to the area opposite image bearing member 1; the measurement results are shown in FIG. 3. The angle ϕ is positive when point a of peak perpendicular magnetic flux density of opposing magnetic pole N is positioned upstream in the developer transport direction relative to the upstream surface 131 of regulating member 13 in the developer transport direction, and the angle ϕ is negative when said point a is positioned downstream therefrom in the developer transport direction.

As shown in FIG. 3, when a regulating member 13 formed of nonmagnetic material was used, an extremely large amount of developer was transported past regulating member 13 to the area opposite image bearing member 1, and the distance Db between the regulating member 13 and developing sleeve 11 had to be reduced in order to adjust the amount of developer transported by developing sleeve 11 to the area opposite image bearing member 1 to a suitable amount.

When a regulating member 13 formed of magnetic material was used, the amount of developer transported past regulating member 13 was reduced compared to the aforesaid regulating member formed of nonmagnetic material, but when the thickness t of the regulating member 13 was less than d/6, i.e., d/12, the amount of developer transported to the area opposite the image bearing member increased in conjunction with the change in the angle ϕ, whereas when the thickness t of the regulating member 13 was d/6 or greater, there was no markedly change in the amount of developer transported to the area opposite image bearing member 1 even when the angle ϕ was varied, such that a constant amount of developer was stabilized and transported to the area opposite image bearing member 1.

EXAMPLE 2

The amount of change in the amount of developer passing the regulating member was measured in conjunction with variation of the thickness of the regulating member.

Magnetic member 12 was set to have a distance d of 15 mm between points c and f on the developing sleeve 11 at which the perpendicular magnetic flux density of opposing magnetic pole N was zero (0) upstream and downstream in the developer transport direction, and the thickness t of regulating member 13 formed of magnetic material was varied.

Figure 4:
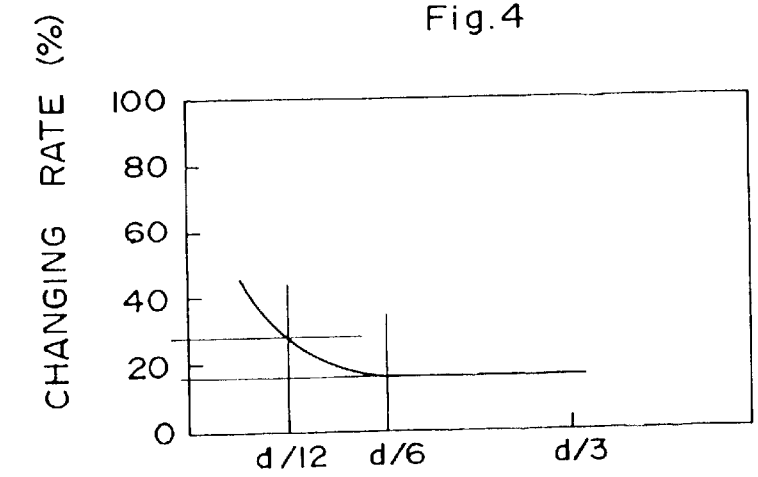
FIG. 4 shows the change in the rate of fluctuation of the amount of transported developer in conjunction with the change in the thickness of the regulating member when the regulating member thickness is varied in the developing device of the first embodiment.

The distance Db between each regulating member 13 and developing sleeve 11 was set at 0.3 mm, and the amount M1 of developer transported to the area opposite the image bearing member 1 by developing sleeve 11 when angle ϕ was set at 0° C. was measured, the amount M2 of developer transported to the area opposite the image bearing member 1 by developing sleeve 11 when angle ϕ was set at +5° was measured, and the rate of change in the amount of developer transported and when angle ϕ was set at 0° and +5° was determined; the results are shown in FIG. 4.

$$\text{Rate of change}=(|M1-M2|/M1)\times 100$$

As shown in FIG. 4, when the thickness t of regulating member 13 formed of magnetic material is less than d/6, the rate of change of the amount of developer gradually increases, such that there is a marked change in the amount of developer transported to the area opposite the image bearing member 1 via the change in the angle ϕ, whereas when the thickness t of regulating member 13 is d/6 or greater, the rate of change of the amount of transported developer is slight, such that there is no marked change in the amount of developer transported to the area opposite the image bearing member 1 by changes of the angle ϕ, and the amount of developer transported to image bearing member 1 is stabilized.

Second Embodiment

Figure 5:
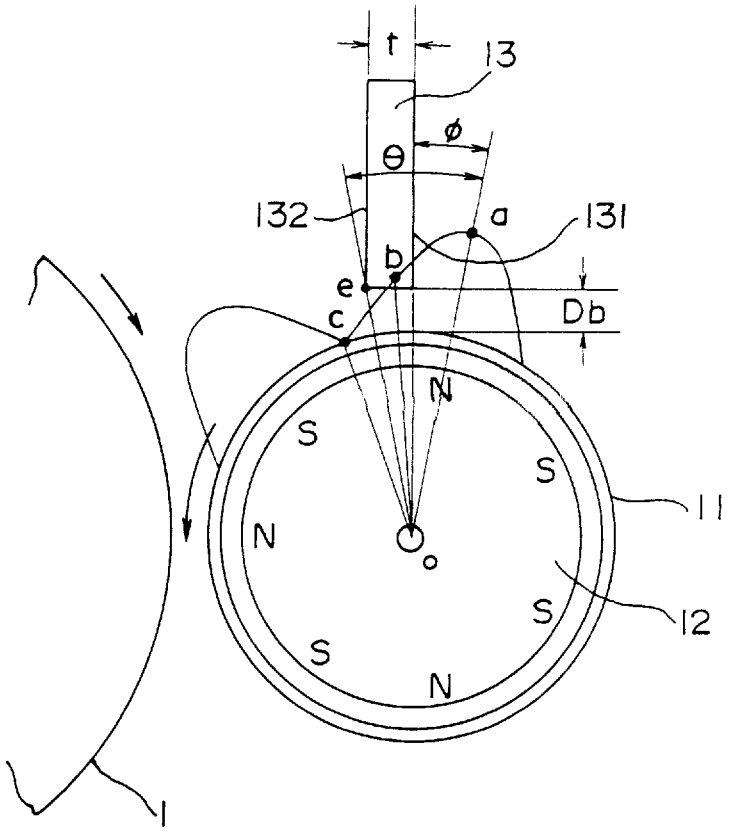
FIG. 5 is a partial view of the developing sleeve periphery in the developing device of a second embodiment of the invention.

In the developing device of the second embodiment, as shown in FIG. 5, the surface 131 of regulating member 13 formed of magnetic material on the upstream side in the developer transport direction is disposed downstream in the developer transport direction from point a of peak perpendicular magnetic flux density of opposing magnetic pole N of magnetic member 12 near the position at which regulating member 13 and developing sleeve 11 are opposed and disposed upstream in the developer transport direction from point b of ½ the peak perpendicular magnetic flux density of opposing magnetic pole N downstream in the developer transport direction from said point a, and the surface 132 of regulating member 13 on the downstream side in the developer transport direction is disposed upstream in the developer transport direction from said point b and disposed upstream in the developer transport direction from point c at which the perpendicular magnetic flux density of opposing magnetic pole becomes zero (0) downstream in the developer transport direction from said point b. In other respects, construction is identical to that of the first embodiment and further discussion is omitted.

When the amount of developer transported to the area opposite the image bearing member 1 by developing sleeve 11 is regulated by the regulating member 13 positioned in the aforesaid manner, there was minimal change in the amount of developer regulated by said regulating member 13 even when the positions of the opposing magnetic pole N and regulating member 13 diverged somewhat to cause variation of the spacing between the regulating member 13 and developing sleeve 11, such that a constant amount of developer was stably transported by developing sleeve 11 to image bearing member 1 to accomplish stable developing.

EXAMPLE 3

In this example, the positional relationship between surface 131 of regulating member 13 on the upstream side in the developer transport direction and point a of peak perpendicular magnetic flux density of opposing magnetic pole N was examined to confirm how it influences allowable error when adjusting the gap Db between the developing sleeve and regulating member.

Magnetic member 12 was set to have an angle (aob) of 15° formed by point a and point b relative to the center 0 of the developing sleeve, and an angle (aoc) of 30° formed by point a and point c. Furthermore, an angle θ (aoe) of 17° was formed by the bottom edge point e of surface 132 of each regulating member 13 on the downstream side in the developer transport direction and point a relative to the center 0 of developing sleeve 11, and surface 132 of regulating member 13 on the downstream side in the developer transport direction was positioned between said points b and c.

Four types of regulating member formed of magnetic material and having a thickness t of 1.5 mm, 2.5 mm. 3.6 mm, and 4.6 mm were used as regulating member 13. The position of surface 131 of each regulating member 13 on the upstream side in the developer transport direction differed in accordance with the change in thickness of the regulating member, and point a and the surface 131 of each regulating member 13 on the upstream side in the developer transport direction formed an angle ϕ of +10°, +5°, 0°,and −5° relative to the center 0 of the developing sleeve.

Figure 6:
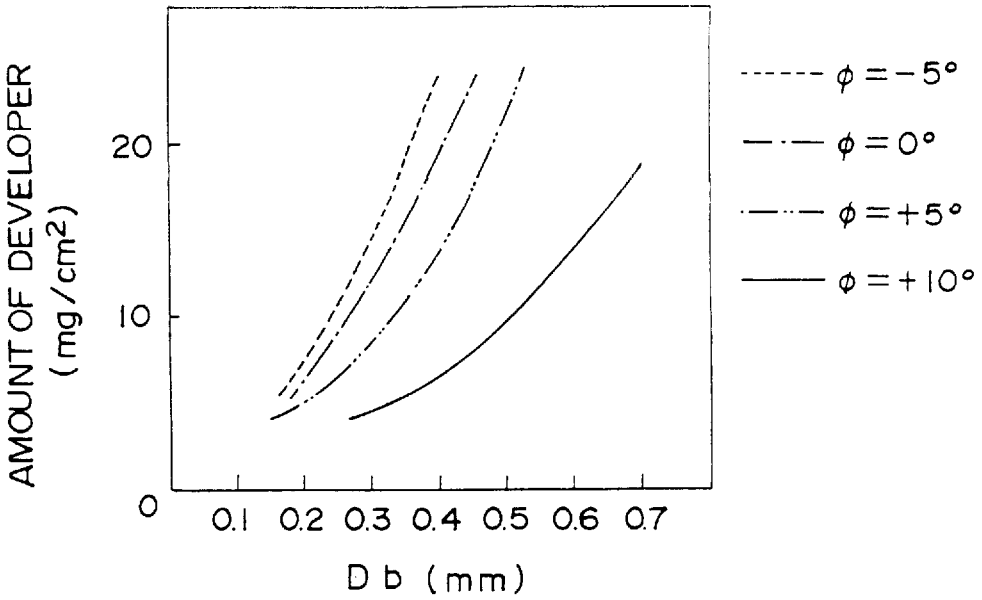
FIG. 6 shows the change in the amount of transported developer when the distance Db between the regulating member and the developing sleeve changes, and the change in the angle $\phi$ formed at the point of peak perpendicular magnetic flux density of the opposing magnetic pole of the magnetic member with the surface of the regulating member on the upstream side in the developer transport direction at the center 0 of the developing sleeve when the regulating member thickness is varied.

The gap Db between each regulating member 13 and the developing sleeve 11 was changed, and the change in the amount of developer passing each regulating member 13 and transported to the area opposite the image bearing member 1 was measured; results are shown in FIG. 6.

The results show minimal change in the amount of transported developer accompanying changes in the gap Db between regulating member 13 and developing sleeve 11 when the angle ϕ was increased on the positive side, and when surface 131 of regulating member 13 on the upstream side in the developer transport direction was positioned between point a and point b with an angle ϕ of +5° and +10°, there was minimal change in the amount of transported developer accompanying change in gap Db compared to when said angle ϕ was set at −5° and 0°

EXAMPLE 4

In this example, the positional relationship between surface 131 of regulating member 13 on the upstream side in the developer transport direction and point a of peak perpendicular magnetic flux density of opposing magnetic pole N was examined to confirm how it influences allowable error when adjusting the gap Db between the developing sleeve and regulating member in the same manner as in example 3.

A regulating member 13 formed of a magnetic material and having a thickness t of 2.5 mm was used, and an angle ϕ of +10° was formed by point a and the surface 131 of regulating member 13 on the upstream side in the developer transport direction relative to the center 0 of the developing sleeve. The gap Db was changed by moving regulating member 13 relative to developing sleeve 11, and the change in the amount of developer passing regulating member 1 and transported to the area opposite the image bearing member 1 was measured; results are shown in FIG. 7.

Figure 7:
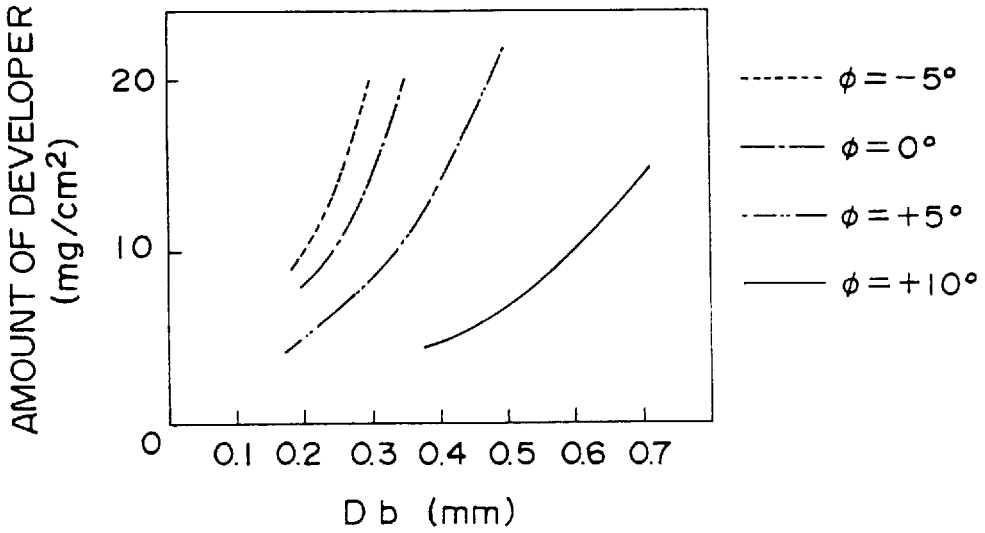
FIG. 7 shows the change of the amount of transported developer when the position of the regulating member is changed to change the angle $\phi$, and the distance Db between the regulating member and the developing sleeve is changed in the developing device of the second embodiment.

In this construction, the angle ϕ formed by point a and surface 131 of regulating member 13 on the upstream side in the developer transport direction was variously set at +5°, 0°, and −5°, and the amount of developer passing regulating member 13 and transported to the area opposite image bearing member 1 was measured; results are shown in FIG. 7.

The results show minimal change in the amount of transported developer accompanying changes in the gap Db between regulating member 13 and developing sleeve 11 when the angle ϕ was increased on the positive side, and surface 131 of regulating member 13 on the upstream side in the developer transport direction was positioned between point a and point b with an angle ϕ of +5° and +10°, there was minimal change in the amount of transported developer accompanying change in gap Db compared to when said angle ϕ was set at −5° and 0°, similar to the findings of FIG. 6.

EXAMPLE 5

In this example, the positional relationship between surface 131 of regulating member 13 on the upstream side in the developer transport direction and point a of peak perpendicular magnetic flux density of opposing magnetic pole N was examined to confirm how it influences the rate of change in the amount of transported developer.

A regulating member 13 having a thickness t of 2.5 mm was used, with a variable angle ϕ formed by point a and the surface 131 of regulating member 13 on the upstream side in the developer transport direction relative to the center 0 of the developing sleeve. The gap Db was varied among 0.45 mm, 0.40 mm, and 0.50 mm to regulate the amount of developer transported by developing sleeve 11 to the area opposite the image bearing member, and the amount of developer passing the regulating member 13 and transported to the area opposite image bearing member 1 was measured.

The amount of transported developer was designated M1 when the gap Db was set at 0.45 mm, designated at M2 when the gap Db was set at 0.40 mm, and designated M3 when the gap Db was set at 0.50 mm. The rate of change in the amount of transported developer was determined by the equation below, and compared to the rate of change accompanying change of angle ϕ; results are shown in FIG. 8.

$$\text{Rate of change}=(|M3-M2|/M1)\times 100$$

Figure 8:
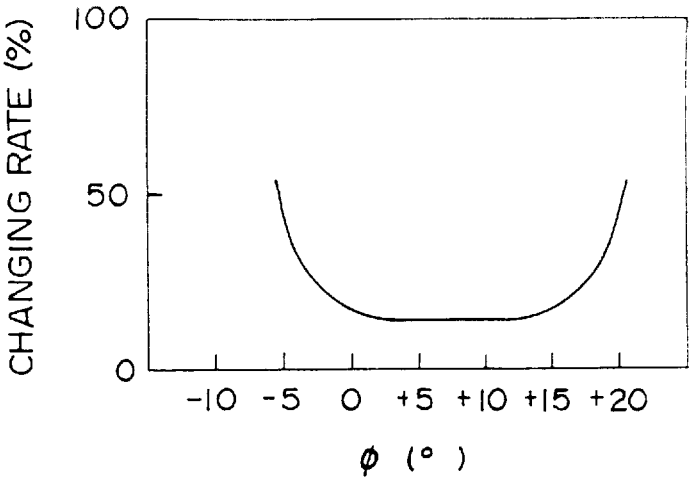
FIG. 8 shows the change in the rate of fluctuation of the amount of transported developer in conjunction with the change in the angle $\phi$ when angle $\phi$ is varied by changing the position of the regulating member in the developing device of the second embodiment.

As shown in FIG. 8, the results show a reduced rate of change in the amount of transported developer when the angle ϕ is set between 0° and 15°, i.e., when the surface 131 of regulating member 13 on the upstream side in the direction of developer transport is positioned between point a of peak perpendicular magnetic flux density of opposing magnetic pole N and point b of ½ the peak perpendicular magnetic flux density.

EXAMPLE 6

In this example, the positional relationship between surface 132 of regulating member 13 on the downstream side in the developer transport direction and point a of peak perpendicular magnetic flux density of opposing magnetic pole N was examined to confirm how it influences allowable error when adjusting the gap Db between the regulating member and the developing sleeve.

Three regulating members 13 formed of magnetic material and having thicknesses t of 1.5 mm, 2.5 mm, and 3.6 mm were used, with an angle ϕ of 5° formed by point a and the surface 131 of each regulating member 13 on the upstream side in the developer transport direction relative to the center 0 of the developing sleeve. The position of the surface 131 of each regulating member 13 on the upstream side in the developer transport direction was set between point a and point b, whereas the position of surface 132 of regulating member 13 on the downstream side in the developer transport direction was varied to change the angle θ formed by point a and bottom edge point e of surface 132 of regulating member 13 on the downstream side in the developer transport direction relative to the center 0 of the developing sleeve to 12°, 17°, and 22°

Figure 9:
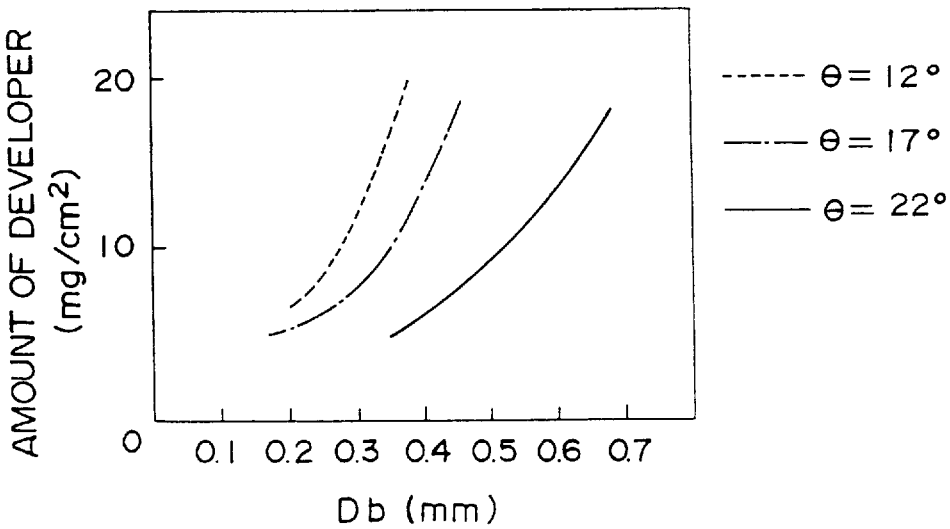
FIG. 9 shows the change in the angle $\theta$ formed at the point of peak perpendicular magnetic flux density of the opposing magnetic pole of the magnetic member with the surface of the regulating member on the downstream side in the developer transport direction at the center 0 of the developing sleeve when the regulating member thickness is varied in the developing device of the second embodiment.

The gap Db between regulating member 13 and developing sleeve 11 was varied, and the amount of developer transported past each regulating member 13 to the area opposite the image bearing member 1 was measured; results are shown in FIG. 9.

The results show there was minimal change in the amount of transported developer accompanying changes of the gap DB produced by increasing the value of angle θ, and there was minimal change in the amount of transported developer accompanying changes in gap Db when surface 132 of regulating member 13 on the downstream side in the developer transport direction was positioned between point b and point c at angle θ of 17° and 22° compared to an angle θ of 12°.

EXAMPLE 7

In this example., the positional relationship between surface 132 of regulating member 13 on the downstream side in the developer transport direction and point a of peak perpendicular magnetic flux density of opposing magnetic pole N was examined to confirm how it influences allowable error when adjusting the gap Db between the regulating member and the developing sleeve.

Figure 10:
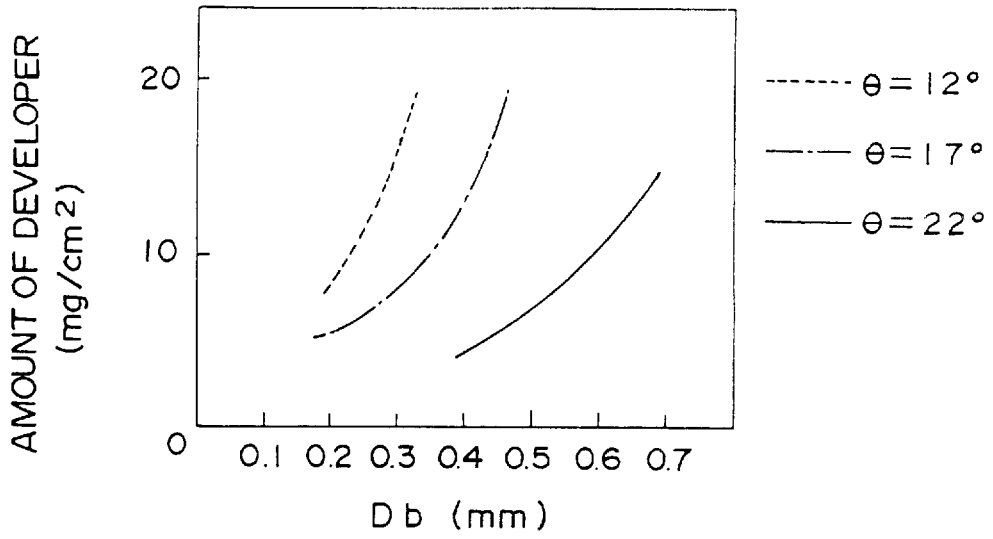
FIG. 10 shows the change in the amount of transported developer when the distance Db between the regulating member and the developing sleeve is changed, and the angle $\theta$ is changed by varying the position of the regulating member in the developing device of the second embodiment.

A regulating member 13 formed of magnetic material and having a thickness t of 2.5 mm was used. The angle θ was variable at 12°, 17°, and 22°, and the gap Db between regulating member 13 and developing sleeve 11 was varied to regulate the amount of developer transported by developing sleeve 11 to the area opposite image bearing member 1. The change in the amount of developer transported past regulating member 13 to the area opposite the image bearing member 1 was measured; results are shown in FIG. 10.

The results show minimal change in the amount of transported developer accompanying changes in the gap Db between regulating member 13 and developing sleeve 11 produced by increasing the angle θ similar to FIG. 9. There was minimal change in the amount of transported developer accompanying changes in gap Db when the surface 132 of regulating member 13 on the downstream side in the developer transport direction was positioned between point b and point c at angle θ of 17° and 22° compared to an angle θ of 12°.

EXAMPLE 8

In this example, what influence, if any, angle θ has on the rate of change of the amount of transported developer was examined.

A regulating member having a thickness t of 2.5 mm was used, and angle θ was varied while the gap Db between regulating member 13 and developing sleeve 11 was variously at 0.45 mm, 0.40 mm, and 0.50 mm to regulate the amount of developer transported by developing sleeve 11 to the area opposite image bearing member 1. The amount of developer transported past regulating member 13 to the area opposite image bearing member 1 was measured.

The amount of transported developer was designated M1 when the gap Db was set at 0.45, designated at M2 when the gap Db was set at 0.40 mm, and designated M3 when the gap Db was set at 0.50 mm. The rate of change in the amount of transported developer was determined by the equation below, and compared to the rate of change accompanying change of angle θ; results are shown in FIG. 11.

$$\text{Rate of change}=(|M3-M2|/M1)\times 100$$

Figure 11:
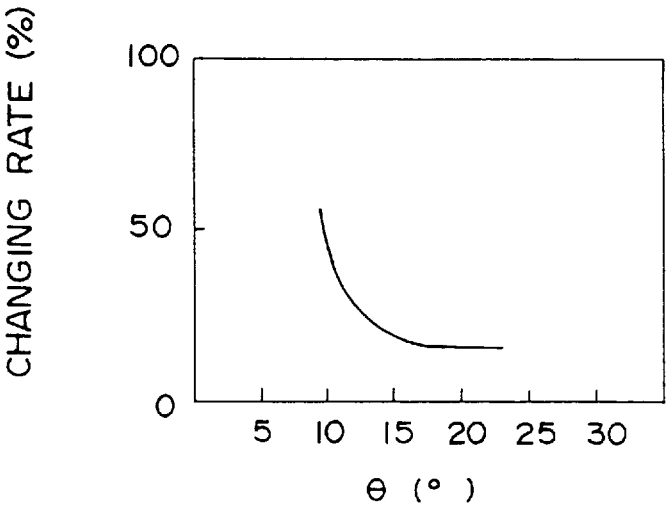
FIG. 11 shows the rate of change in the amount of transported developer in conjunction with the change in the angle $\theta$ when the angle $\theta$ is changed by varying the position of the regulating member in the developing device of the second embodiment.
Figure 12:
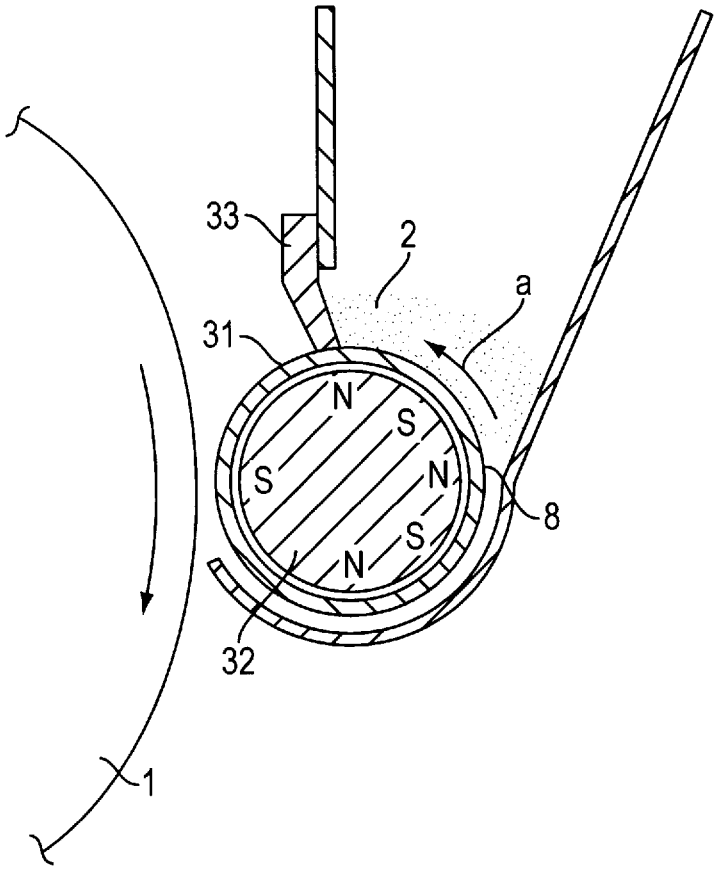
FIG. 12 (PRIOR ART)
FIG. 12 is a brief partial view showing a conventional developing device.

As shown in FIG. 11, the results show a reduced rate of change in the amount of transported developer when surface 132 of regulating member 13 on the downstream side in the developer transport direction was positioned downstream in the developer transport direction from point b of ½ the peak perpendicular magnetic flux density of opposing magnetic pole N with an angle θ of 15° or more, and there was minimal fluctuation in the amount of transported developer accompanying change in the gap Db.

In each of the aforesaid developing devices of the present invention described above, regulation of the amount of developer transported by a developing sleeve to an image bearing member is accomplished by providing a regulating member opposite said developing sleeve so as to maintain a predetermined spacing therebetween, forming the regulating member of magnetic material and setting the thickness of said regulating member as described above, and setting the positional relationship between the regulating member and the opposing magnetic pole of the magnetic member as described above, such that developer transported by the developing sleeve to the image bearing member is regulated in a stable state by the regulating member even when the gap between the regulating member, when and developing sleeve varies and the positions of the regulating member and opposing electrode shift, thereby stably transporting a constant amount of developer to the image bearing member without marked increase in the amount of developer transported by the developing sleeve to the image bearing member so as to maintain suitable developing The present invention is not limited to the previously described devices inasmuch as the surface 131 of regulating member 13 on the upstream side in the developer transport direction may be disposed downstream in the developer transport direction from point a of peak perpendicular magnetic flux density of opposing magnetic pole N and upstream in the developer transport direction from point b of ½ the peak perpendicular magnetic flux density of opposing magnetic pole N, and surface 132 of regulating member 13 on the downstream side in the developer transport direction may be disposed downstream in the developer transport direction from said point b and upstream in the developer transport direction from point c at which the perpendicular magnetic flux density of opposing magnetic pole N becomes zero (0), and even more excellent effectiveness can be obtained if regulating member 13 satisfies the relationship $t \geqq d/6$.

The developing device of the present invention is not restricted to devices using two-component developer comprising a toner and carrier, and may be applied to devices using developer comprising only a magnetic toner.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A developing device comprising:

a magnetic member having a plurality of magnetic poles N and S within a developing sleeve which rotates to transport developer to an image bearing member, said magnetic member being fixed and thereby prevented from rotating, and a regulating member formed of magnetic material disposed so as to maintain a predetermined spacing from said developing sleeve, wherein the relationship $t \geqq d/6$ is satisfied when the thickness of said regulating member is designated t, and the distance on the developing sleeve is designated d between points where the perpendicular magnetic flux density become 0 (zero) on the upstream side and downstream side in the developer transport direction at the opposing magnetic pole of said magnetic member near the position at which the regulating member faces the developing sleeve.

2. A developing device as claimed in claim 1, wherein the relationship $t \geqq d/3$ is satisfied.

3. A developing device comprising:

a magnetic member having a plurality of magnetic poles N and S within a developing sleeve which rotates to transport developer to an image bearing member, and a regulating member formed of a magnetic material disposed so as to maintain a predetermined spacing from said developing sleeve, said regulating member having a planar portion parallel to a plane tangential to the surface of the developing sleeve, wherein the surface of the regulating member on the upstream side in the direction of developer transport is disposed downstream in the developer transport direction from a point of peak perpendicular magnetic flux density of the opposing magnetic pole of the magnetic member near the position at which the regulating member faces the developing sleeve, upstream in the developer transport direction from a point of ½ the peak perpendicular magnetic flux density of said opposing magnetic pole, wherein the surface of the regulating member on the downstream side in the direction of developer transport is disposed downstream in the developer transport direction from a point of ½ the peak perpendicular magnetic flux density of said opposing magnetic pole, and upstream in the developer transport direction from a point where the perpendicular magnetic flux density of said opposing magnetic pole become 0 (zero).

4. A developing device as claimed in claim 3, wherein a distance between the point of ½ the peak perpendicular magnetic flux density of the opposing magnetic pole and the surface of the regulating member on the upstream side in the developer transport direction is shorter than that between the point of ½ the peak perpendicular magnetic flux density of the opposing magnetic pole and the surface of the regulating member on the downstream side in the developer transport direction.

5. A developing device comprising:

a magnetic member having a plurality of magnetic poles N and S within a developing sleeve which rotates to transport developer to an image bearing member, and a regulating member formed of magnetic material disposed so as to maintain a predetermined distance from said developing sleeve, said regulating member having a planar portion parallel to a plane tangential to the surface of the developing sleeve, wherein the surface of the regulating member on the downstream side in the direction of developer transport is disposed downstream in the developer transport direction from a point of ½ the peak perpendicular magnetic flux density of the opposing magnetic pole of the magnetic member near the position at which the regulating member faces the developing sleeve, and upstream in the developer transport direction from a point where the perpendicular magnetic flux density of said opposing magnet pole becomes 0 (zero).

* * * * *